US012716238B2

(12) United States Patent
Ellis et al.

(10) Patent No.: US 12,716,238 B2
(45) Date of Patent: Aug. 25, 2026

(54) BUNDLE OF ROOFING SHINGLES, AND ASSOCIATED KIT, SYSTEM, AND METHOD

(71) Applicant: BMIC LLC, Dallas, TX (US)

(72) Inventors: David Ellis, Perkasie, PA (US); Eric R. Anderson, Montclair, NJ (US); Lyan Ortiz Alemany, Waxahachie, TX (US); Nicholas Soto, Waxahachie, TX (US); Brian Simon, Ennis, TX (US)

(73) Assignee: BMIC LLC, Dallas, TX (US)

( * ) Notice: Subject to any disclaimer, the term of this patent is extended or adjusted under 35 U.S.C. 154(b) by 190 days.

(21) Appl. No.: 18/479,886

(22) Filed: Oct. 3, 2023

(65) Prior Publication Data

US 2024/0110379 A1 Apr. 4, 2024

Related U.S. Application Data

(60) Provisional application No. 63/413,049, filed on Oct. 4, 2022.

(51) Int. Cl.
*E04D 1/30* (2006.01)

(52) U.S. Cl.
CPC ..... *E04D 1/30* (2013.01); *E04D 2001/301* (2013.01)

(58) Field of Classification Search
CPC ..... E04D 1/30; E04D 2001/301
See application file for complete search history.

(56) References Cited

U.S. PATENT DOCUMENTS

| | | | |
|---|---|---|---|
| 3,815,212 | A | 6/1974 | Breckenfelder |
| 8,453,341 | B2 | 6/2013 | Elsasser |
| 9,808,947 | B2 | 11/2017 | Grubka et al. |
| 10,308,448 | B2 | 6/2019 | Belt et al. |
| 10,364,573 | B2 † | 7/2019 | Folkersen |
| 10,487,508 | B2 | 11/2019 | Grubka et al. |
| 10,640,979 | B2 | 5/2020 | Grubka et al. |
| 10,662,651 | B2 | 5/2020 | Jenkins |
| 11,519,176 | B2 | 12/2022 | Leitch |
| 12,168,545 | B2 | 12/2024 | Niedzwiecki et al. |
| 12,305,395 | B2 | 5/2025 | Lowrey et al. |
| 12,338,627 | B2 | 6/2025 | Srinivasa et al. |
| 2004/0123545 | A1 | 7/2004 | Phillips |
| 2005/0252141 | A1 | 11/2005 | Kerkar et al. |
| 2006/0179767 | A1 | 8/2006 | Miller et al. |
| 2006/0265989 | A1 | 11/2006 | Geary |
| 2009/0249740 | A1 | 10/2009 | Crookston |

(Continued)

FOREIGN PATENT DOCUMENTS

CA 2910614 A1 4/2017

*Primary Examiner* — Travis M Figg
(74) *Attorney, Agent, or Firm* — Venable LLP

(57) ABSTRACT

A bundle of roofing shingles, including at least four rows of roofing shingles, where the at least four rows of roofing shingles includes a first roofing shingle row, a second roofing shingle row, a third roofing shingle row, and a fourth roofing shingle row, where the first roofing shingle row includes a first roofing shingle having a first length; and where the second roofing shingle row includes: a second roofing shingle having a second length, and a third roofing shingle having a third length, where the second roofing shingle is adjacent the third roofing shingle, where the second length is greater than the third length, and where the second row is located above the first row.

23 Claims, 3 Drawing Sheets

(56) References Cited

U.S. PATENT DOCUMENTS

| | | | | |
|---|---|---|---|---|
| 2010/0205887 | A1 | 8/2010 | Riina | |
| 2010/0275534 | A1* | 11/2010 | Ruskin | E04D 1/30 52/173.3 |
| 2011/0185650 | A1* | 8/2011 | Kalkanoglu | E04D 1/30 52/173.3 |
| 2011/0277408 | A1* | 11/2011 | Turek | E04D 1/30 52/311.1 |
| 2013/0042540 | A1* | 2/2013 | Atchley | E04D 1/30 52/57 |
| 2018/0313088 | A1* | 11/2018 | Folkersen | E04D 1/30 |
| 2020/0200411 | A1* | 6/2020 | Daniels | E04D 1/30 |
| 2020/0248459 | A1* | 8/2020 | Kirkey | E04D 1/24 |
| 2020/0263905 | A1* | 8/2020 | Daniels | E04D 1/30 |
| 2021/0317661 | A1* | 10/2021 | Svec | E04D 1/365 |
| 2022/0186499 | A1 | 6/2022 | Srinivasa et al. | |
| 2022/0389715 | A1 | 12/2022 | Lane et al. | |
| 2023/0063983 | A1 | 3/2023 | Leitch et al. | |

* cited by examiner
† cited by third party

BUNDLE OF ROOFING SHINGLES, AND ASSOCIATED KIT, SYSTEM, AND METHOD

This application claims the priority of U.S. provisional application Ser. No. U.S. 63/413,049 entitled "Bundle of Roofing Shingles, and Associated Kit, System, and Method" filed Oct. 4, 2022, which is incorporated herein by reference in its entirety for all purposes.

FIELD OF THE INVENTION

The present invention relates to roofing materials, and, more particularly, to bundles of roofing shingles.

BACKGROUND

When installing roofing shingles on a roofing substrate, the left and right ends of the roofing shingles in rows above and below one other on the roofing substrate are offset from one another. Restated, when comparing two roofing shingles in two rows that are immediately above and below each other, the ends of the roofing shingles which are on the roofing substrate do not align with each other. This offset between ends of roofing shingles provides improved water resistance to the roofed roofing substrate, as compared to a roofed roofing substrate where the left and right ends of the roofing shingles, in each row, align with one another.

Further, when installing the roofing shingles on the roofing substrate, the ends of the roofing shingles overhang the left and right rakes (that is, edges) of the roofing substrate. Generally, a roofer installs the first row of roofing shingles on the roofing substrate so that a full roofing shingle is a leftmost roofing shingle, for example, on the roofing substrate, and the roofer works from left to right installing some number of full roofing shingles in the first row. Also, the leftmost roofing shingle in the first row overhangs the left rake a specified amount, and accordingly, the leftmost roofing shingle sets the overhang for all of the roofing shingles in each of the rows, on the left rake of the roofing substrate, from the eave to the apex (that is, from the bottom to the top) of the roofing substrate.

Generally, after the roofer installs some portion of the first row, the roofer begins installing the second row of roofing shingles on the roofing substrate, where the second row is immediately above the first row. Generally, the roofer offsets the right side of the leftmost roofing shingle in the second row, because doing so provides the above-described offset between the right ends of the roofing shingles in the first and second rows. After the roofer completely covers the roofing substrate with multiple rows of roofing shingles, the roofer will then cut the overhanging roofing shingles on the left rake, for example, with greater or lesser success, so that the leftmost edges of each of the roofing shingles along the left rake are aligned with one another.

SUMMARY

Covered embodiments are defined by the claims, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

In some embodiments, the disclosure provides a bundle of roofing shingles, comprising: at least four rows of roofing shingles, wherein the at least four rows of roofing shingles comprises a first roofing shingle row, a second roofing shingle row, a third roofing shingle row, and a fourth roofing shingle row, wherein the first roofing shingle row comprises a first roofing shingle having a first length; and wherein the second roofing shingle row comprises: a second roofing shingle having a second length, and a third roofing shingle having a third length, wherein the second roofing shingle is adjacent the third roofing shingle, wherein the second length is greater than the third length, and wherein the second row is located above the first row.

In some embodiments, the first length is equal to a total of the second length and the third length.

In some embodiments, the first length is greater than a total of the second length and the third length.

In some embodiments, the third roofing shingle row comprises a fourth roofing shingle having the first length, and the third roofing shingle row is located above the second roofing shingle row.

In some embodiments, the fourth roofing shingle row comprises a fifth roofing shingle and a sixth roofing shingle, the fifth roofing shingle is adjacent the sixth roofing shingle, and the fourth roofing shingle row is located above the third roofing shingle row.

In some embodiments, the fifth roofing shingle has the second length, and the sixth roofing shingle has the third length.

In some embodiments, the at least four rows of roofing shingles comprises a fifth roofing shingle row, the fifth roofing shingle row comprises a seventh roofing shingle and an eighth roofing shingle, the seventh roofing shingle is adjacent the eighth roofing shingle, and the fifth roofing shingle row is located below the first roofing shingle row, as a bottommost row in the bundle.

In some embodiments, the seventh roofing shingle has the second length, and the eighth roofing shingle has the third length.

In some embodiments, the second length is ⅔ of the first length, and the third length is ⅓ of the first length.

In some embodiments, the second length is less than ⅔ and greater than ⅓ of the first length, and the third length is less than ⅓ of the first length.

In some embodiments, the first roofing shingle row includes only the first roofing shingle.

In some embodiments, the first roofing shingle is pre-cut at one or more perforated regions to create at least one of the second roofing shingle or the third roofing shingle.

In some embodiments, the second roofing shingle row includes only the second and third roofing shingles.

In some embodiments, the disclosure provides a kit comprising: a plurality of first bundles of roofing shingles, wherein each of the first bundles of roofing shingles comprises at least four rows of roofing shingles, wherein the at least four rows of roofing shingles comprises a first roofing shingle row, a second roofing shingle row, a third roofing shingle row, and a fourth roofing shingle row, wherein the first roofing shingle row comprises a first roofing shingle having a first length; and wherein the second roofing shingle row comprises: a second roofing shingle having a second length, and a third roofing shingle having a third length, wherein the second roofing shingle is adjacent the third roofing shingle in the second roofing shingle row, wherein the second length is greater than the third length, and wherein the second roofing shingle row is located above the first roofing shingle row.

In some embodiments, the kit further comprises a plurality of second bundles of roofing shingle, wherein each of the second bundles of roofing shingles comprises a plurality of roofing shingle rows each comprising a single roofing shingle, and wherein each of the roofing shingles in the second bundles of roofing shingles is the first length.

In some embodiments, the disclosure provides a method, comprising: obtaining a first bundle of roofing shingles, at least four rows of roofing shingles, wherein the at least four rows of roofing shingles comprises a first roofing shingle row, a second roofing shingle row, a third roofing shingle row, and a fourth roofing shingle row, wherein the first roofing shingle row comprises a first roofing shingle having a first length; and wherein the second roofing shingle row comprises: a second roofing shingle having a second length, and a third roofing shingle having a third length, wherein the second roofing shingle is adjacent the third roofing shingle, wherein the second length is greater than the third length, and wherein the second row is located above the first row, wherein the third roofing shingle row comprises at least a fourth roofing shingle, and wherein the fourth roofing shingle row comprises at least a fifth roofing shingle and a sixth roofing shingle; disposing the first, second, third, fourth, fifth, and sixth roofing shingles above a roofing substrate.

In some embodiments, the at least four rows of roofing shingles comprises a fifth roofing shingle row, wherein the fifth roofing shingle row comprises a seventh roofing shingle and an eighth roofing shingle, wherein the seventh roofing shingle is adjacent the eighth roofing shingle, and wherein the fifth roofing shingle row is located below the first roofing shingle row, as a bottommost row in the bundle; and wherein the method further comprises disposing the seventh roofing shingle and the eighth roofing shingle above the roofing substrate.

In some embodiments, the at least four rows of roofing shingles comprises more than five rows of shingles.

In some embodiments, the first roofing shingle is pre-cut at one or more perforated regions to obtain at least one of the second roofing shingle or the third roofing shingle.

In some embodiments, the method further comprises disposing an underlayment on the roofing substrate; and disposing the first, second, third, fourth, fifth, and sixth roofing shingles above a roofing substrate comprises disposing the first, second, third, fourth, fifth, and sixth roofing shingles on the underlayment.

In some embodiments, disposing the first, second, third, fourth, fifth, and sixth roofing shingles above the roofing substrate comprises disposing the first, second, third, fourth, fifth, and sixth roofing shingles directly on the roofing substrate without an intervening layer between the roofing shingles and the roofing substrate.

In some embodiments, the disclosure provides a method comprising: obtaining data regarding a roofing substrate of a building structure, wherein the data comprises: a roof pitch, a roof length, and a roof width; calculating, based on the data, each of: a number of first roofing shingles, each of the first roofing shingles having a first length, and a number of second roofing shingles, each of the second roofing shingles having a second length, to roofing shingle the roof; cutting with a machine, based on the calculating, one or more first roofing shingles to obtain the calculated number of second roofing shingles; and stacking the calculated number of first roofing shingles and the calculated number of second roofing shingles in one or more bundles of roofing shingles.

In some embodiments, the method further comprises generating a report indicating the calculated number of first roofing shingles and the calculated number of second roofing shingles to roofing shingle the roof.

In some embodiments, stacking the calculated number of first roofing shingles and the calculated number of second roofing shingles in one or more bundles of roofing shingles comprises stacking the calculated number of first roofing shingles in one or more bundles of first roofing shingles; and stacking the calculated number of second roofing shingles in one or more bundles of second roofing shingles.

In some embodiments, the disclosure provides a method comprising: obtaining an image of a roofing substrate of a building structure; extracting, from the image, data regarding the roofing substrate, wherein the data comprises: a roof pitch, a roof length, and a roof width; calculating, based on the data, each of: a number of first roofing shingles, each of the first roofing shingles having a first length, and a number of second roofing shingles, each of the second roofing shingles having a second length to roofing shingle the roof; cutting with a machine, based on the calculating, one or more first roofing shingles to obtain the calculated number of second roofing shingles; and stacking the calculated number of first roofing shingles and the calculated number of second roofing shingles in one or more bundles of roofing shingles.

In some embodiments, the disclosure provides a method comprising: obtaining an image of a roofing substrate of a building structure; comparing, with a machine learning module, the image to a plurality of images stored in a memory of the module; extracting, based on a result of the comparison, data regarding the roofing substrate, wherein the data comprises: a roof pitch, a roof length, and a roof width; calculating, based on the data, each of: a number of first roofing shingles, each of the first roofing shingles having a first length, and a number of second roofing shingles, each of the second roofing shingles having a second length, to roofing shingle the roof; cutting with a machine, based on the calculating, one or more first roofing shingles to obtain the calculated number of second roofing shingles; and stacking the calculated number of first roofing shingles and the calculated number of second roofing shingles in one or more bundles of roofing shingles.

BRIEF DESCRIPTION OF THE DRAWINGS

Reference is made to the drawings that form a part of this disclosure, and which illustrate embodiments in which the materials and methods described herein can be practiced.

DETAILED DESCRIPTION

Figure 1:
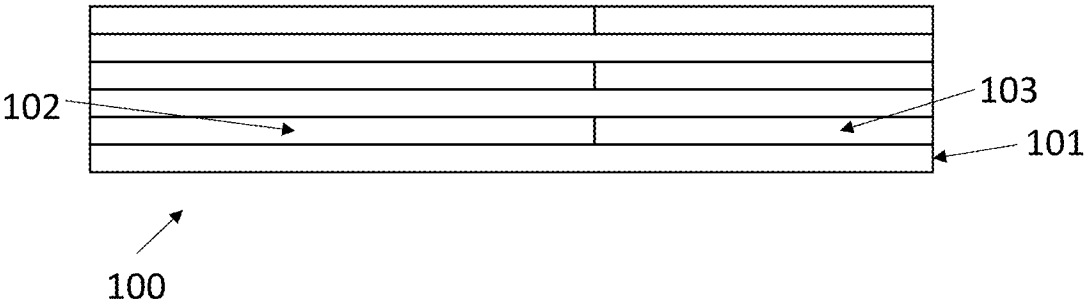
FIG. 1 is a side view of a portion of a bundle of roofing shingles, in accordance with some embodiments of the invention.

Among those benefits and improvements that have been disclosed, other objects and advantages of this disclosure will become apparent from the following description taken in conjunction with the accompanying figures. Detailed embodiments of the present disclosure are disclosed herein; however, the disclosed embodiments are merely illustrative of the disclosure that may be embodied in various forms. In addition, each of the examples given regarding the various embodiments of the disclosure which are intended to be illustrative, and not restrictive.

Throughout the specification and claims, the following terms take the meanings explicitly associated herein, unless the context clearly dictates otherwise. The phrases "in an embodiment," "in some embodiments," and any similar phrase, as used herein, do not necessarily refer to the same embodiment or embodiments, though the phrases may refer to the same embodiment or embodiments. Furthermore, the phrases "in another embodiment," and any similar phrase, as used herein, do not necessarily refer to a different embodiment, although the phrases may refer to a different embodiment. All embodiments of the disclosure are intended to be combinable without departing from the scope or spirit of the disclosure.

As used herein, terms such as "comprising" "including," "having," and any similar phrase, do not limit the scope of a specific claim to the materials or steps recited by the claim.

As used herein, terms such as "consisting of" limit the scope of a specific claim to the materials and steps recited by the claim.

In some embodiments, the disclosure may provide one or more bundles of roofing shingles. In some embodiments, the bundle of roofing shingles may include a first roofing shingle row, and a second roofing shingle row. In some embodiments, the first roofing shingle row may comprise a first roofing shingle having a first length. In some embodiments, the second roofing shingle row may include a second roofing shingle having a second length, and a third roofing shingle having a third length.

In some embodiments, the first roofing shingle row may be below the second roofing shingle row. In some embodiments, the first roofing shingle row may be directly below the second roofing shingle row, without an intervening roofing shingle row between the first roofing shingle row and the second roofing shingle row. In some embodiments, the first roofing shingle row may not be directly below the second roofing shingle row, because there may be an intervening roofing shingle row between the first roofing shingle row and the second roofing shingle row. As used here, terms such as "above" and "below" may mean that rows of roofing shingles are directly above or directly below one another, such that the other row of roofing shingles are between rows described as "above" or "below" one another. However, in some embodiments, one or more rows of shingles may be between any rows of shingles described herein.

In some embodiments, the first roofing shingle row may be above the second roofing shingle row. In some embodiments, the first roofing shingle row may be directly above the second roofing shingle row, without an intervening roofing shingle row between the first roofing shingle row and the second roofing shingle row. In some embodiments, the first roofing shingle row may not be directly above the second roofing shingle row, because there may be an intervening roofing shingle row between the first roofing shingle row and the second roofing shingle row.

In some embodiments, the first and second roofing shingle rows may alternate with one another. In some embodiments, the first and second roofing shingle rows may not alternate with one another. In some embodiments, there may be multiple first roofing shingle rows between second roofing shingle rows. In some embodiments, there may be multiple second roofing shingle rows between first roofing shingle rows.

In some embodiments, the first roofing shingle row may include only one first roofing shingle. In some embodiments, the first roofing shingle row may include more than one first roofing shingle. In some embodiments, the first roofing shingle row may include multiple first roofing shingles. In some embodiments, the second roofing shingle row may include one second roofing shingle and one third roofing shingle. In some embodiments, the second roofing shingle row may include one or more second roofing shingles, and/or one or more third roofing shingles. In some embodiments, the second roofing shingle row may include the second roofing shingle located adjacent the third roofing shingle. As used here, "adjacent" may mean that two shingles are next to one another with no intervening shingle therebetween. However, in some embodiments, one or more shingle may be between any two shingles described herein.

In some embodiments, the first roofing shingle is pre-cut at one or more perforated regions (or lines) to create at least one of the second roofing shingle or the third roofing shingle.

In some embodiments, the second roofing shingle row may include one or more other types of roofing shingles, besides the second roofing shingle and the third roofing shingle. In some embodiments, the second roofing shingle row one or more second roofing shingles, one or more third roofing shingles, and/or one or more fourth roofing shingles. In some embodiments, the second roofing shingle row one or more second roofing shingles, one or more third roofing shingles, one or more fourth roofing shingles, and/or one or more fifth roofing shingles. In some embodiments, the second roofing shingle row one or more second roofing shingles, one or more third roofing shingles, one or more fourth roofing shingles, one or more fifth roofing shingles, and/or one of more sixth roofing shingles. In some embodiments, the second roofing shingle row one or more second roofing shingles, one or more third roofing shingles, one or more fourth roofing shingles, one or more fifth roofing shingles, one of more sixth roofing shingles, and/or one or more seventh roofing shingles. In some embodiments, the second roofing shingle row may include eight or more roofing shingles.

In some embodiments, the total length of the roofing shingles in the second row may be equal to the total length of the roofing shingle(s) in the first row. In some embodiments, the total length of the roofing shingles in the second row may be less than the total length of the roofing shingle(s) in the first row. In some embodiments, the total length of the roofing shingles in the second row may be equal to the total length of the roofing shingle(s) in the first row minus the material that is removed when cutting the first roofing shingle(s) into the roofing shingles in the second roofing shingle row. In some embodiments, the total length of the roofing shingles in the second row may be equal to the total length of the roofing shingle(s) in the first row minus the material that is removed when cutting the first roofing shingle(s) into the second roofing shingle(s) and the third roofing shingle(s).

In some embodiments, the first roofing shingle may be a whole roofing shingle. In some embodiments, the second roofing shingle may be a ⅔ roofing shingle. In some embodiments, the second roofing shingle may be used in a situation where a full roofing shingle may have been used otherwise and at least ⅓ of the full roofing shingles would have been expected to have been cut from the full roofing shingle. In some embodiments, the third roofing shingle may be a ⅓ roofing shingle. In some embodiments, the third roofing shingle may be used in a situation where a full roofing shingle may have been used otherwise and at least ⅔ of the full roofing shingles would have been expected to have been cut from the full roofing shingle.

In some embodiments, the second and third roofing shingles may be obtained by cutting the first roofing shingle into the second roofing shingle that is ⅔ of the length of the first roofing shingle, and the third roofing shingle that is ⅓ of the length of the first roofing shingle. In some embodiments, the second and third roofing shingles may be obtained by cutting the first roofing shingle into the second roofing shingle that is less than ⅔ of the length of the first roofing shingle, because of the material removed during cutting, and the third roofing shingle that is less than ⅓ of the length of the first roofing shingle, because of the material removed during cutting.

In some embodiments, the second and/or third roofing shingles may be obtained by providing a first roofing shingle that is pre-cut or has an easy to separate feature, such as, e.g., a perforated region (or line) in a headlap region of the roofing shingle, in order to allow for easy separation and the obtaining of the second and/or third roofing shingles from the first roofing shingle.

In some embodiments, the second roofing shingle and/or the third roofing shingle may be other fractions of the length of the first roofing shingle. By way of non-limiting example, in some embodiments, the second roofing shingle may be a ¾ roofing shingle, and the third roofing shingle may be a ¼ roofing shingle. In some embodiments, the second and third roofing shingles may be obtained by cutting a first roofing shingle into the second roofing shingle that is ¾ of the length of the first roofing shingle, and the third roofing shingle that is ¼ of the length of the first roofing shingle. In some embodiments, the second and third roofing shingles may be obtained by cutting the first roofing shingle into the second roofing shingle that is less than ¾ of the length of the first roofing shingle, because of the material removed during cutting, and the third roofing shingle that is less than ¼ of the length of the first roofing shingle, because of the material removed during cutting. In some embodiments, any of the fractions "⅓," "⅔," "¼," and "¾" may be any other fraction, such as, but not limited to, one or more of ½, ⅕, ⅖, ⅗, ⅘, ⅙, ⅚, ⅐, ⅔, ⅗, ⅘, ⅙, ⅚, ⅐, ⅔, ⅗, ⅘, ⅛, ⅜, ⅝, ⅞, ⅛, ⅜, ⅝, ⅞, ⅛, ⅜, ⅝, ⅞ roofing shingles. In some embodiments, the first roofing shingles may have a first length. In some embodiments, one or more of the first roofing shingles may be cut into one or more second roofing shingles having a second length, and one or more third roofing shingles having a third length. In some embodiments, one or more of the first roofing shingles is pre-cut at one or more perforated regions (or lines) to create at least one of the second roofing shingle or the third roofing shingle. In some embodiments, the first length may be greater than a total of the second length and the third length. In some embodiments, the first length may be equal to the total of the second length and the third length. In some embodiments, wherein the second length may be greater than the third length.

In some embodiments, one or more of the first roofing shingles, one or more of the second roofing shingles, and/or one or more of the third roofing shingles may be stacked into one or more bundles of roofing shingles. In some embodiments, one of the first roofing shingles may be the only roofing shingle in a row of roofing shingles of at least one of the bundles of roofing shingles. In some embodiments, one of the second roofing shingles and one of the third roofing shingles may be the only roofing shingles in a row of roofing shingles of at least one of the bundles of roofing shingles. In some embodiments, a row with the first roofing shingle may be an uppermost and/or a bottommost row of roofing shingles in one or more of the bundles of roofing shingles. In some embodiments, a row with the second and third roofing shingles may be an uppermost and/or a bottommost row of roofing shingles in one or more of the bundles of roofing shingles.

In some embodiments, rows of roofing shingles may be stacked within the one or more bundles of roofing shingles as one or more first roofing shingles are cut into one or more second roofing shingles and one or more third roofing shingles. In some embodiments, rows of roofing shingles may be stacked within one or more bundles of shingles, after a plurality of first roofing shingles are cut into a plurality of second roofing shingles and a plurality of third roofing shingles. As used herein, the term "plurality" may refer to more than one.

In some embodiments, the disclosure may provide a method of determining how many of the first roofing shingles, the second roofing shingles, and the third roofing shingles may be used to roof a roofing substrate.

In some embodiments, the method may include obtaining data regarding a roofing substrate of a building structure, wherein the data may include one or more of, or all of, a roof pitch, a roof length, and a roof width. In some embodiments, the data may be measured, such as by a roof. In some embodiments, the method may include calculating, based on the data, each of a number of first roofing shingles, each of the first roofing shingles having a first length, and a number of second roofing shingles, each of the second roofing shingles having a second length, to roofing shingle the roof.

In some embodiments, the method may include cutting with a machine, one or more first roofing shingles to obtain the calculated number of second roofing shingles. In some embodiments, an operator receives data and cuts the second roofing shingles. In some embodiments, the machine receives data and cuts the second roofing shingles.

In some embodiment, the method may include obtaining one or more first roofing shingles having one or more perforated regions to obtain the calculated number of second roofing shingles.

In some embodiments, the method may include stacking the calculated number of first roofing shingles and the calculated number of second roofing shingles in one or more bundles of roofing shingles.

In some embodiments, a method may include installing the roofing shingles on a roofing substrate. In some embodiments, the roofing substrate may be covered by a base material, such that the roofing shingles are not directly disposed or installed on the roofing substrate. In some embodiments, the base material may be a self-adhesive material. In some embodiments, the base material may be a non-self-adhesive material that is adhered and/or otherwise attached to the roofing substrate. In some embodiments, the base material may be a synthetic underlayment. In some embodiments, the roofing shingles may be installed directly on the roofing substrate—that is, the base material may be omitted. In some embodiments, the roofing shingles may include at least one line of sealant or adhesive along an edge (e.g., the rake edge) of the roofing shingles to adhere the roofing shingles onto a roofing substrate and/or a base material, and to thereby improve the wind uplift of the roofing shingles along the edge (e.g., the rake edge).

In some embodiments, the method may include obtaining an image of a roofing substrate of a building structure. In some embodiments, the method may include extracting, from the image, data regarding the roofing substrate, wherein the data comprises one or more of, or all of, a roof pitch, a roof length, and/or a roof width. In some embodiments, the roofer may evaluate the photograph to extract the information. In some embodiments, a computer may extract the information.

In some embodiments, the method may include comparing, with a machine learning module, the image to a plurality of images stored in a memory of the module. In some embodiments, the method may include extracting, based on a result of the comparison, data regarding the roofing substrate.

The method may include computer hardware, including a non-transitory memory, specifically storing and running one or more computer programs or applications. The one or more computer programs or applications may calculate the number of first roofing shingles, and/or the number of second roofing shingles, as disclosed. In some embodiments, the one or more computer programs or applications may evaluate the photograph to extract the information, as disclosed. In some embodiments, the one or more computer programs or applications may evaluate, using the machine learning module, the image to a plurality of images stored in a memory of the module, and/or may extract, based on a result of the comparison, data regarding the roofing substrate, as described.

In some embodiments, the method may include generating a report indicating the calculated number of first roofing shingles. In some embodiments, the method may include generating a report indicating the calculated number of second roofing shingles to roofing shingle the roof. In some embodiments, the one or more computer programs or applications may generate either or both reports.

In some embodiments, the method may include stacking the calculated number of first roofing shingles in one or more bundles of first roofing shingles, and stacking the calculated number of second roofing shingles in one or more bundles of second roofing shingles. In some embodiments, a worker may stack the roofing shingles in the roofing shingle bundles. In some embodiments, machinery may stack the roofing shingles in the roofing shingle bundles.

Turning to the figures, FIG. 1 shows a sideview of a portion of a roofing shingle bundle 100, in accordance with some embodiments of the invention. Although the figure shows six (6) roofing shingle rows, the roofing shingle bundle 100 may include more or less roofing shingle rows.

As shown in the figure, in some embodiments, the roofing shingle bundle 100 may include one or more roofing shingle rows, such as a first, third, and fifth roofing shingle row (from the bottom), with a first roofing shingle 101. The roofing shingle bundle 100 may also include one or more roofing shingle rows, such as a second, fourth, and sixth roofing shingle row (from the bottom), with second roofing shingles 102 and third roofing shingles 103. The first, second, and/or third roofing shingles may be in accordance with the first, second, and/or third roofing shingles described herein. Although the figure shows the roofing shingle rows alternating, the roofing shingle bundle 100 may not include alternating rows. For example, in some embodiments, there may be two or more roofing shingle rows with first roofing shingles 101, which are between roofing shingles rows with second roofing shingles 102 and 103. By way of another example, in some embodiments, there may be two or more roofing shingle rows with second roofing shingles 102 and third roofing shingles 103, which are between roofing shingle rows with first roofing shingles 101. In some embodiments, a roofing shingle row with first roofing shingle 101 may be an uppermost roofing shingle row. In some embodiments, a roofing shingle row with second roofing shingle 102 and third roofing shingle 103 may be the uppermost roofing shingle row. In some embodiments, a roofing shingle row with first roofing shingle 101 may be a lowermost roofing shingle row. In some embodiments, a roofing shingle row with second roofing shingle 102 and third roofing shingle 103 may be the lowermost roofing shingle row. Although the figure shows the roofing shingle bundle 100 with each of the second roofing shingles 102 on the same side of the roofing shingle bundle 100, and each of the third roofing shingles 103 of the opposite side of the roofing shingle bundle 100, the second roofing shingles 102 and the third roofing shingles 103 need not always be on the same side of the roofing shingle bundle 100.

In some embodiments, the lengths of the second roofing shingles 102 may be ⅔ of the length of the first roofing shingles 101. In some embodiments, the lengths of the second roofing shingles 102 may be less than ⅔ of the length of the first roofing shingles, because of material removed when cutting first roofing shingles 101 to form the second roofing shingles 102. In some embodiments, the lengths of the third roofing shingles 103 may be ⅓ of the length of the first roofing shingles 101. In some embodiments, the lengths of the third roofing shingles 103 may be less than ⅓ of the length of the first roofing shingles, because of material removed when cutting first roofing shingles 101 to form the third roofing shingles 103.

Figure 2:
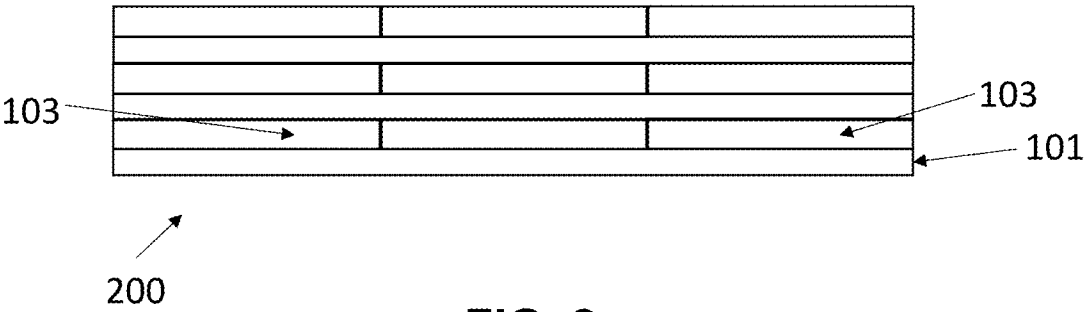
FIG. 2 is a side view of a portion of a bundle of roofing shingles, in accordance with some embodiments of the invention.

FIG. 2 shows a sideview of a portion of a roofing shingle bundle 200, in accordance with some embodiments of the invention. Although the figure shows six (6) roofing shingle rows, the roofing shingle bundle 200 may include more or less roofing shingle rows.

As shown in the figure, in some embodiments, the roofing shingle bundle 200 may include one or more roofing shingle rows, such as a first, third, and fifth roofing shingle row (from the bottom), with the first roofing shingle 201. The roofing shingle bundle 200 may also include one or more roofing shingle rows, such as a second, fourth, and sixth roofing shingle row (from the bottom), with third roofing shingles 103. The first and/or third roofing shingles may be in accordance with the first and/or third roofing shingles described herein. Although the figure shows the roofing shingle rows alternating, the roofing shingle bundle 100 may not include alternating rows. For example, in some embodiments, there may be two or more roofing shingle rows with first roofing shingles 101 between roofing shingles rows with third roofing shingles 103. By way of another example, in some embodiments, there may be two or more roofing shingle rows with third roofing shingles 103 between roofing shingle rows with first roofing shingles 101. In some embodiments, a roofing shingle row with first roofing shingle 101 may be an uppermost roofing shingle row. In some embodiments, a roofing shingle row with third roofing shingles 103 may be the uppermost roofing shingle row. In some embodiments, a roofing shingle row with first roofing shingle 101 may be a lowermost roofing shingle row. In some embodiments, a roofing shingle row with third roofing shingles 103 may be the lowermost roofing shingle row.

In some embodiments, the lengths of the third roofing shingles may be ⅓ of the length of the first roofing shingles 101. In some embodiments, the lengths of the third roofing shingles 103 may be less than ⅓ of the length of the first roofing shingles, because of material removed when cutting first roofing shingles 101 to form the third roofing shingles 103.

In some embodiments, a kit may include one or more of the roofing shingle bundles 100, and/or one or more of the roofing shingle bundles 200, and/or one or more roofing shingle bundles including only first roofing shingles 101.

Figure 3:
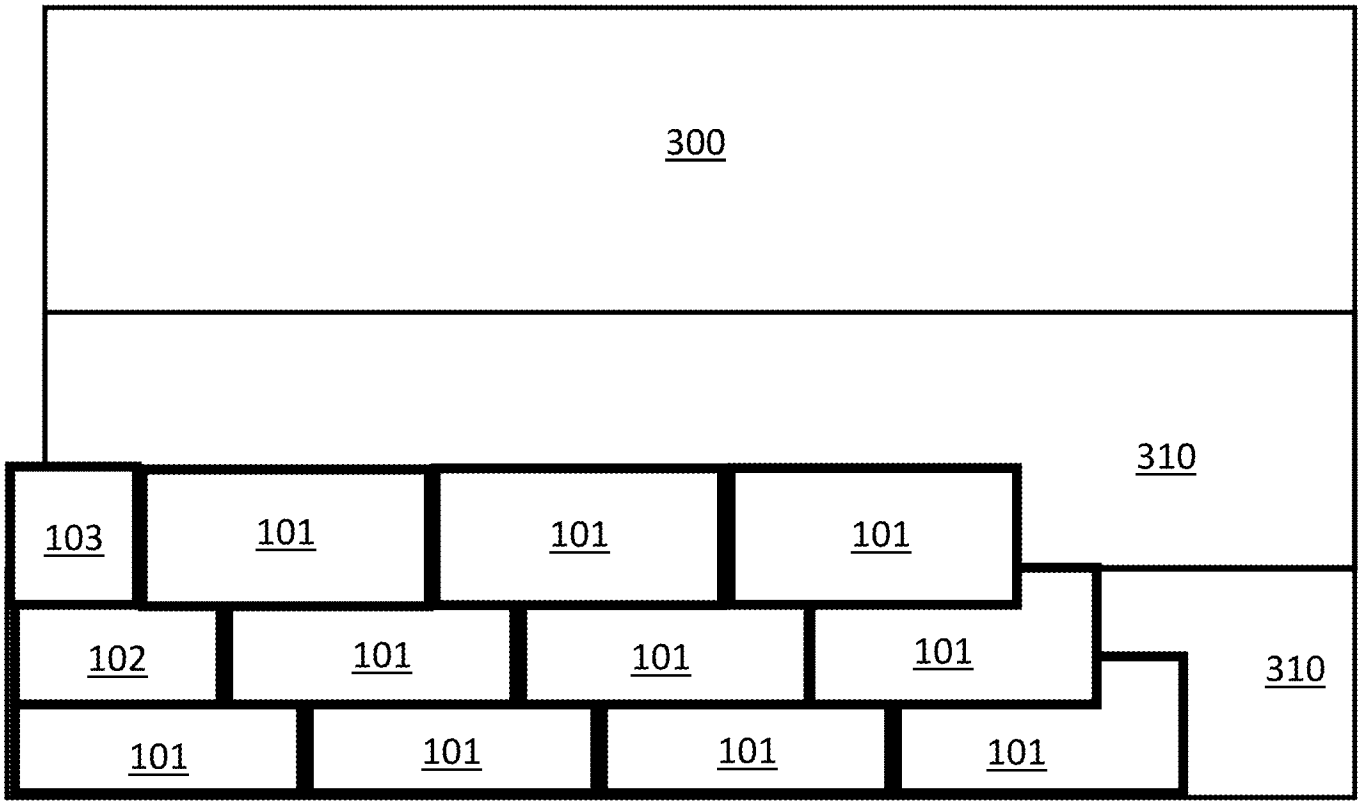
FIG. 3 is a top view of a roofing substrate, partially roofed, in accordance with some embodiments of the invention.

FIG. 3 shows a top view of a roofing substrate 300 partially roofed, in accordance with some embodiments. As shown in the figure, roofing substrate 300 is covered by a base material 310, such that the roofing shingles are not directly disposed or installed on the roofing substrate 300. In some embodiments, the base material 310 may be a self-adhesive material. In some embodiments, the base material 310 may be a non-self-adhesive material that is adhered and/or otherwise attached to the roofing substrate 300. In some embodiments, the base material 310 may be a synthetic underlayment. In some embodiments, the roofing shingles may be installed directly on the roofing substrate 300—that is, the base material 310 may be omitted.

As shown in the figure, one first roofing shingle 101, one second roofing shingle 102, and one third roofing shingle 103 are installed with an appropriate overhang over the left-side rake of the roofing substrate 310. In some embodiments, a roofer may install the leftmost first roofing shingle 101 with an appropriate overhang over the left rake, for example, thereby setting the overhang for subsequent rows of roofing shingles installed on the roofing substrate 300.

Accordingly, a roofer may not need to cut any of the roofing shingles overhanging the left-side rake of the roofing substrate 310. Instead, using the first, second, and third roofing shingles 101, 102, and 103, may provide an appropriate offset of the right ends of the roofing shingles, and/or also may align the overhanging left ends of the roofing shingles, which overhang the left-side rake of the roofing substrate 300.

In some embodiments, the roofing shingles may be organized within the roofing shingle bundles, such that an order of roofing shingles within the bundles may be in accordance with an expected installation of the roofing shingles on the roofing substrate. For example, with reference to FIG. 3, the invention may provide bundles of roofing shingles in which one or more of each of the roofing shingles 101, 102, and 103 are organized as described. Accordingly, in some embodiments, the installer would not need to search for the appropriate, next roofing shingle during roofing of the roofing substrate 300. Therefore, in some embodiments, use of the roofing shingle bundles in accordance with the invention may increase productivity, reduce installation time, and/or reduce errors during installation. In one embodiment, one or more bundles may be provided that include only the rake edge shingles, while one or more additional bundles may be provided that include the other shingles (e.g., shingles 101, 102, and/or 103) needed for the expected installation. In some embodiments, one or more bundles may be provided that only include the first roofing shingles 101, while one or more additional bundles may be provided that include the other shingles (e.g., shingles 102 and 103) to complete the installation.

It will be appreciated that, in some embodiments, the roofing shingles may be "pre-cut"—that is, rather than being cut on the jobsite, the roofing shingles may be cut before arriving on the jobsite, such as in a factory, industrial, and/or commercial setting. In some embodiments, the pre-cut roofing shingles may be stacked into bundles before being arriving at a jobsite—such as, for example, in a factory, industrial, and/or commercial setting.

Figure 4:
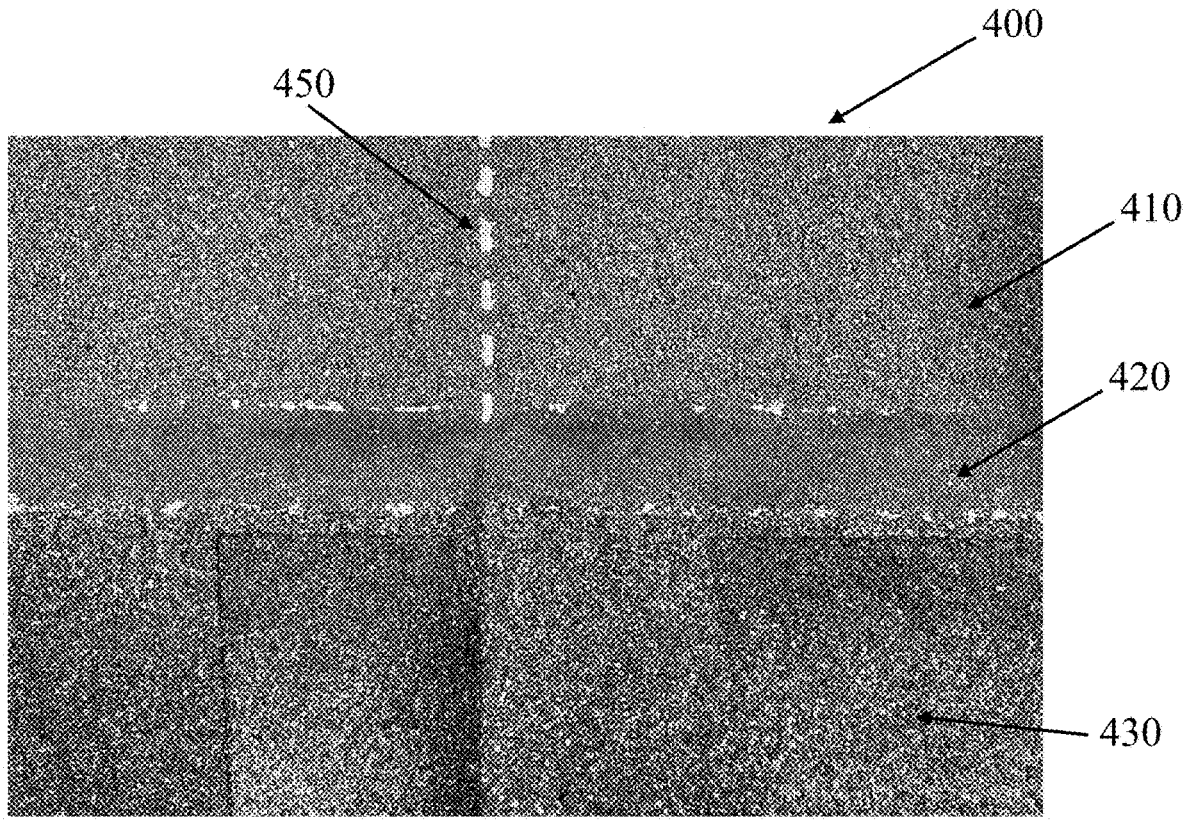
FIG. 4 is an image of a roofing shingle having a pre-cut, perforated line, in accordance with some embodiments of the invention.

According to some embodiments, one or more of the first roofing shingles may be "pre-cut" with a perforated line to allow for the obtaining of the second and/or third roofing shingles while at the jobsite. For example, FIG. 4 shows an image of a roofing shingle 400 having a pre-cut, perforated line 450, in accordance with some embodiments of the invention. As shown in FIG. 4, the roofing shingle 400 includes a headlap region 410, a nail zone 420, and a tab region (or exposure zone) 430. The roofing shingle 400 further includes a pre-cut, perforated line 450 along the headlap region 410. As shown in FIG. 4, this pre-cut, perforated line 450 extends from the top of the headlap region 410 of the roofing shingle 400 to the beginning of the nail zone 420 and/or the tab region (or exposure zone) 430. According to some embodiments, the tab region (or exposure zone) 430 is machine cut at one or more edges and/or is machine cut into one or more tabs that will be visible upon installing the roofing shingle 400 onto a roof. Thus, according to some embodiments, the tab region (or exposure zone) 430 includes a factory or machine cut edge along the tab region (or exposure zone) 430 that is fully cut to thereby provide a clean edge. The pre-cut, perforated line 450 of the roofing shingle 400 allows for the roofing shingle 400 to be easily separated into one or more smaller roofing shingles (such as, e.g., second roofing shingle 102 and/or third roofing shingle 103), so that an installer does not have to cut the shingle by hand during installation, including at the rake edge.

It will be further appreciated that, in some embodiments, because the roofing shingles may be provided in different lengths, there may be less waste on the jobsite. It will be appreciated still further that, in some embodiments, installation of the roofing shingles may require less cutting, and, therefore, a total amount of time installing the roofing shingles on the roofing substrate may be reduced.

It will be appreciated still further that, in some embodiments, use of the roofing shingles of different lengths may provide roofing shingles that are aligned along at least one rake edge of the roofing substrate, without cutting the roofing shingles overhanging the rake edge. Thus, the roofing system as disclosed herein may provide a more aesthetically-pleasing rake edge, and/or may be installed in less time, as compared to a conventional roofing system which typically requires snapping a line, and cutting the conventional shingles along the line to remove portions of the shingles overhanging the rake edge.

It will be appreciated still further that, in some embodiments, roofing shingles having a pre-cut, perforated region (or line) are provided to obtain smaller roofing shingles (e.g., second and/or third roofing shingles) by easily separating the roofing shingle(s) along the pre-cut, perforated region. This allows for a roofing shingle to be easily separated into one or more smaller roofing shingles, so that an installer does not have to cut the shingle by hand during installation, including at the rake edge. This can improve the customer and/or installation experience (e.g., an easier to install a shingle roofing system), including along the rake edge areas. This can also eliminate the need for a contractor to measure and hand cut a shingle during installation, including along the rake edge. Thus, the roofing system as disclosed herein may provide an improved visual effect and/or a more aesthetically-pleasing installed roofing system with respect to a factory cut edge, as opposed to a hand cut edge. The roofing system disclosed herein can further ensure shingle installation offset is correct. Roofing bundles disclosed herein can also be provided with such roofing shingles having a pre-cut, perforated region, which can facilitate bundle packaging.

In some embodiments, one or more of the roofing shingles may include a sealant. In some embodiments, the sealant may be disposed at an edge of the roofing shingle which is configured to be disposed at a rake edge of the roofing substrate. In some embodiments, the sealant may improve wind uplift resistance.

Variations, modifications, and alterations to one or more of the embodiments of the disclosure described above will make themselves apparent to those skilled in the art. All such variations, modifications, alterations, and the like are intended to fall within the spirit and scope of the present disclosure, limited solely by the appended claims.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. Thus, for example, in each instance herein, any of the terms "comprising," "consisting essentially of" and "consisting of" may be replaced with either of the other two terms, without altering their respective meanings as defined herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

We claim:

1. A bundle of roofing shingles, the bundle comprising:

a stack having at least four vertically stacked rows of roofing shingles, wherein the at least four vertically stacked rows of roofing shingles comprises a first roofing shingle row, a second roofing shingle row located vertically above the first roofing shingle row, a third roofing shingle row located vertically above the second roofing shingle row, and a fourth roofing shingle row located vertically above the third roofing shingle row, wherein the first roofing shingle row consists of one or more first roofing shingles having a first length;

wherein the second roofing shingle row consists of:

one or more second roofing shingles having a second length, and one or more third roofing shingles having a third length, wherein each second roofing shingle of the one or more second roofing shingles is adjacent to a third roofing shingle of the one or more third roofing shingles in the second roofing shingle row, wherein the second length is greater than the third length, and wherein the bundle of roofing shingles is stacked into the stack having the at least four vertically stacked rows of roofing shingles prior to installing the roofing shingles onto a roof.

2. The bundle of roofing shingles according to claim 1, wherein the first length is equal to a total of the second length and the third length.

3. The bundle of roofing shingles according to claim 1, wherein the first length is greater than a total of the second length and the third length.

4. The bundle of roofing shingles according to claim 1, wherein the third roofing shingle row comprises a fourth roofing shingle having the first length, and wherein the third roofing shingle row is located above the second roofing shingle row.

5. The bundle of roofing shingles according to claim 4, wherein the fourth roofing shingle row comprises a fifth roofing shingle and a sixth roofing shingle, wherein the fifth roofing shingle is adjacent the sixth roofing shingle, and wherein the fourth roofing shingle row is located above the third roofing shingle row.

6. The bundle of roofing shingles according to claim 5, wherein the fifth roofing shingle has the second length, and wherein the sixth roofing shingle has the third length.

7. The bundle of roofing shingles according to claim 6, wherein the at least four rows of roofing shingles comprises a fifth roofing shingle row, wherein the fifth roofing shingle row comprises a seventh roofing shingle and an eighth roofing shingle, wherein the seventh roofing shingle is adjacent the eighth roofing shingle, and wherein the fifth roofing shingle row is located below the first roofing shingle row, as a bottommost row in the bundle.

8. The bundle of roofing shingles according to claim 7, wherein the seventh roofing shingle has the second length, and wherein the eighth roofing shingle has the third length.

9. The bundle of roofing shingles according to claim 1, wherein the second length is ⅔ of the first length, and the third length is ⅓ of the first length.

10. The bundle of roofing shingles according to claim 1, wherein the second length is less than ⅔ and greater than ⅓ of the first length, and the third length is less than ⅓ of the first length.

11. The bundle of roofing shingles according to claim 1, wherein the first roofing shingle row includes only a single first roofing shingle.

12. The bundle of roofing shingles according to claim 1, wherein the second roofing shingle row includes only a second roofing shingle and a third roofing shingle.

13. The bundle of roofing shingles according to claim 1, wherein the first roofing shingle comprises one or more perforated regions configured to create at least one of another second roofing shingle having the second length or another third roofing shingle having the third length.

14. A kit comprising:

a plurality of first bundles of roofing shingles for installing onto a roof, wherein each of the first bundles of roofing shingles comprises a stack having at least four vertically stacked rows of roofing shingles, wherein the at least four vertically stacked rows of roofing shingles comprises a first roofing shingle row, a second roofing shingle row located vertically above the first roofing shingle row, a third roofing shingle row located vertically above the second roofing shingle row, and a fourth roofing shingle row located vertically above the third roofing shingle row, wherein the first roofing shingle row consists of one or more first roofing shingles having a first length; and wherein the second roofing shingle row consists of:

one or more second roofing shingles having a second length, and one or more third roofing shingles having a third length, wherein each second roofing shingle of the one or more second roofing shingles is adjacent to a third roofing shingle of the one or more third roofing shingles in the second roofing shingle row, wherein the second length is greater than the third length, and wherein each of the first bundles of roofing shingles is stacked into the stack having the at least four vertically stacked rows of roofing shingles prior to installing the roofing shingles onto the roof.

15. The kit according to claim 14, wherein the first length is equal to a total of the second length and the third length.

16. The kit according to claim 14, wherein the first length is greater than a total of the second length and the third length.

17. The kit according to claim 14, wherein the third roofing shingle row comprises a fourth roofing shingle having the first length, and wherein the third roofing shingle row is located above the second roofing shingle row.

18. The kit according to claim 17, wherein the fourth roofing shingle row comprises a fifth roofing shingle and a sixth roofing shingle, wherein the fifth roofing shingle is adjacent the sixth roofing shingle, and wherein the fourth roofing shingle row is located above the third roofing shingle row.

19. The kit according to claim 18, wherein the fifth roofing shingle having the second length, and wherein the sixth roofing shingle having the third length.

20. The kit according to claim 14, wherein the first roofing shingle row includes only a single first roofing shingle.

21. The kit according to claim 14, wherein the second roofing shingle row includes only a second roofing shingle and a third roofing shingle.

22. The kit according to claim 14, further comprising:

a plurality of second bundles of roofing shingles for installing onto the roof, wherein each of the second bundles of roofing shingles comprises a stack having a plurality of roofing shingle rows each comprising a single roofing shingle, and wherein each of the roofing shingles in the second bundles of roofing shingles is the first length, and wherein each of the second bundles of roofing shingles is stacked into stack having the plurality of shingle rows prior to installing the roofing shingles onto the roof.

23. The kit according to claim 14, wherein the first roofing shingle comprises one or more perforated regions configured to create at least one of another second roofing shingle having the second length or another third roofing shingle having the third length.

* * * * *